US008515697B2

(12) United States Patent
Alexander et al.

(10) Patent No.: US 8,515,697 B2
(45) Date of Patent: Aug. 20, 2013

(54) APPARATUS AND METHOD FOR VITAL SIGNAL STATE DETECTION IN OVERLAY RAIL SIGNAL MONITORING

(75) Inventors: Michael Alexander, Pittsburgh, PA (US); James Brown, Allison Park, PA (US); Bernard Clement, Milwaukee, WI (US); Kelly Berger, Harmony, PA (US); James Riling, Pittsburgh, PA (US); Joseph Reutzel, Pittsburgh, PA (US)

(73) Assignee: Ansaldo STS USA, Inc., Pittsburgh, PA (US)

( * ) Notice: Subject to any disclaimer, the term of this patent is extended or adjusted under 35 U.S.C. 154(b) by 373 days.

(21) Appl. No.: 13/037,939

(22) Filed: Mar. 1, 2011

(65) Prior Publication Data

US 2011/0276285 A1 Nov. 10, 2011

Related U.S. Application Data

(60) Provisional application No. 61/331,875, filed on May 6, 2010.

(51) Int. Cl.
*G01R 31/02* (2006.01)

(52) U.S. Cl.
USPC ..... 702/58; 702/64; 246/122 R; 246/167 R; 701/19; 701/20

(58) Field of Classification Search
USPC ..... 702/58, 64; 340/641, 600, 907; 250/205; 246/20, 27, 34 R, 35, 41, 122 R, 246/167 R, 176, 76; 701/19, 20, 204, 207, 701/205, 117; 324/500
See application file for complete search history.

(56) References Cited

U.S. PATENT DOCUMENTS 2,243,722 A 5/1941 Staples
3,995,262 A 11/1976 France et al.

(Continued)

FOREIGN PATENT DOCUMENTS

WO 2008116429 A1 10/2008
WO 2009100292 A1 8/2009
WO 2009139927 A2 11/2009

OTHER PUBLICATIONS

Petit, Bill, Communications-Based Signaling (CBS)—Vital PTC, AREMA C&S Technical Conference May 22, 2007.

(Continued)

*Primary Examiner* — Carol S Tsai
(74) *Attorney, Agent, or Firm* — Eckert Seamans Cherin & Mellott, LLC; Philip E. Levy

(57) ABSTRACT

A railroad monitoring apparatus includes first and second diverse vital processing units, first and second current sensors configured to measure the current being provided to one or more signaling elements of an item of wayside signaling equipment, and means for measuring voltage levels being supplied to each of the signaling elements. The first processing unit receives a first current measurement from the first current sensor and the measured voltage levels, and the second vital processing unit receives a second current measurement from the second current sensor and the measured voltage levels. The vital processing units are each programmed to determine based on one or more of the first current measurement, the second current measurement and the measured voltage levels: (i) the state of the item of railroad wayside signaling equipment, (ii) failures within the item of railroad wayside signaling equipment, and (iii) failures within the monitoring apparatus itself.

22 Claims, 3 Drawing Sheets

(56) References Cited

U.S. PATENT DOCUMENTS

| | | | | |
|---|---|---|---|---|
| 4,451,018 | A | 5/1984 | Smith et al. | |
| 4,583,086 | A | 4/1986 | Andrews et al. | |
| 4,667,187 | A | 5/1987 | Volk et al. | |
| 4,668,946 | A | 5/1987 | Volk et al. | |
| 4,912,471 | A * | 3/1990 | Tyburski et al. | 340/10.34 |
| 5,631,843 | A | 5/1997 | Munday et al. | |
| 5,767,781 | A | 6/1998 | Yavelberg | |
| 5,798,690 | A | 8/1998 | Grieser-Schmitz | |
| 5,883,337 | A | 3/1999 | Dolan et al. | |
| 6,392,553 | B1 | 5/2002 | Mollet et al. | |
| 6,688,561 | B2 * | 2/2004 | Mollet et al. | 246/473.1 |
| 6,799,097 | B2 * | 9/2004 | Villarreal Antelo et al. | 701/19 |
| 6,965,307 | B2 | 11/2005 | Pearson, Jr. et al. | |
| 7,140,577 | B2 * | 11/2006 | Mollet et al. | 246/218 |
| 7,154,403 | B2 * | 12/2006 | Davenport et al. | 340/641 |
| 7,254,467 | B2 * | 8/2007 | Fries et al. | 701/19 |
| 7,652,480 | B2 | 1/2010 | Mollet | |
| 7,663,323 | B2 | 2/2010 | Telefont | |
| 8,005,632 | B2 | 8/2011 | Zettel et al. | |
| 8,028,961 | B2 * | 10/2011 | Ashraf et al. | 246/167 R |
| 2004/0181321 | A1 * | 9/2004 | Fries et al. | 701/19 |
| 2005/0062481 | A1 * | 3/2005 | Vaughn et al. | 324/500 |
| 2005/0253689 | A1 * | 11/2005 | Mollet et al. | 340/286.01 |
| 2006/0001547 | A1 * | 1/2006 | Davenport et al. | 340/641 |
| 2006/0076461 | A1 * | 4/2006 | DeRose et al. | 246/122 R |
| 2007/0208841 | A1 * | 9/2007 | Barone et al. | 709/223 |
| 2009/0143928 | A1 | 6/2009 | Ghaly | |
| 2010/0013402 | A1 | 1/2010 | Chaffai et al. | |
| 2011/0144933 | A1 * | 6/2011 | Hoelscher | 702/64 |

OTHER PUBLICATIONS

Petit, William A., Interoperable Positive Train Control (PTC), AREMA 2009 Annual Conference Communications and Signals Track.

* cited by examiner

| RED LAMP VOLTAGE DETECTED | YELLOW LAMP VOLTAGE DETECTED | GREEN LAMP VOLTAGE DETECTED | CURRENT DETECTED | DECLARED STATE |
|---|---|---|---|---|
| X | | | X | RED |
| | X | | X | YELLOW |
| | | X | X | GREEN |
| | | | | DARK SIGNAL |
| X | | | | UNKNOWN/LAMP-OUT |
| | X | | | UNKNOWN/LAMP-OUT |
| | | X | | UNKNOWN/LAMP-OUT |
| X | X | | | UNKNOWN/LAMP-OUT |
| X | | X | | UNKNOWN/LAMP-OUT |
| | X | X | | UNKNOWN/LAMP-OUT |
| X | X | X | | UNKNOWN/LAMP-OUT |
| | | | X | UNKNOWN/ERROR |
| X | X | | X | UNKNOWN/ERROR |
| X | | X | X | UNKNOWN/ERROR |
| | X | X | X | UNKNOWN/ERROR |
| X | X | X | X | UNKNOWN/ERROR |

*FIG.3*

APPARATUS AND METHOD FOR VITAL SIGNAL STATE DETECTION IN OVERLAY RAIL SIGNAL MONITORING

CROSS-REFERENCE TO RELATED APPLICATIONS

This application claims priority under 35 U.S.C. §119(e) from U.S. Provisional Application No. 61/331,875, entitled "Combinational Use of Voltage and Current Inputs for Vital Signal State Detection in Overlay Rail Signal Monitoring", filed on May 6, 2010, the disclosure of which is incorporated herein by reference.

BACKGROUND OF THE INVENTION

1. Field of the Invention

The present invention relates to the railroad signaling, and in particular to an apparatus and method for vitally monitoring and determining the state of wayside signaling equipment.

2. Description of the Related Art

Railroad systems include various types of wayside equipment which is located at geographically dispersed positions along the track. Such wayside equipment includes wayside signaling equipment, including signal lamps, switches and hazard detectors, which communicate track information, such as right-of-way information, speed restrictions, and track condition information, to trains traveling along the track.

Positive train control (PTC) refers to various technologies that are used to monitor and control the movements of trains to provide increased safety. A typical PTC system consists of a centralized control center, an on-board computer provided on the train, various types of wayside equipment as just described, and a wireless communication system that allows for wireless communications between the elements just identified. More specifically, such PTC systems typically employ an overlay system wherein each piece of wayside equipment is operatively coupled to a wayside interface device that monitors the status of wayside equipment in a fail safe manner and wirelessly transmits the status to the on-board computer of each oncoming train. For example, a wayside interface device may be coupled to a signal lamp (having individual red, yellow and green lamps) for monitoring and reporting the aspect of the signal lamp to oncoming trains. In PTC systems, it is important that wayside interface devices not falsely interpret and broadcast the state of the associated wayside signaling equipment in a more permissive manner. In other words, if such wayside interface device are going to fail, they should fail into a safe (less permissive) mode for the train.

While many known PTC systems employing an overlay system as just described have proven to be effective in certain situations, there is room for improvement in the field of positive train control, and in particular as it relates to monitoring and determining the state of wayside signaling equipment.

SUMMARY OF THE INVENTION

In one embodiment, a monitoring apparatus for determining the state of an item of railroad wayside signaling equipment having a plurality of signaling elements is provided. The monitoring apparatus includes a first vital processing unit, a second vital processing unit separate and diverse from the first vital processing unit, a current sensing unit having a first current sensor and a second current sensor, the first current sensor and the second current sensor each being configured to measure a current being provided to one or more of the plurality of signaling elements, and means for measuring a plurality of voltage levels, each of the voltage levels being a voltage level being supplied to a respective one of the plurality of signaling elements. The first vital processing unit receives a first current measurement from the first current sensor and each of the measured voltage levels, the second vital processing unit receives a second current measurement from the second current sensor and each of the measured voltage levels, and the first vital processing unit and the second vital processing unit are each programmed to determine based on one or more of the first current measurement, the second current measurement and the measured voltage levels: (i) the state of the item of railroad wayside signaling equipment, (ii) failures within the item of railroad wayside signaling equipment, and (iii) failures within the monitoring apparatus itself.

In another embodiment, a method of determining the state of an item of railroad wayside signaling equipment having a plurality of signaling elements is provided. The method includes providing a monitoring apparatus having a first vital processing channel and a second vital processing channel separate and diverse from the first vital processing channel, making a first current measurement and a second current measurement, both the first current measurement and the second current measurement comprising a measurement of a current being provided to one or more of the plurality of signaling elements, receiving in the first vital processing channel the first current measurement and receiving in the second vital processing channel the second current measurement, measuring a plurality of voltage levels, each of the voltage levels being a voltage level being supplied to a respective one of the plurality of signaling elements, and receiving the measured voltage levels in the first vital processing channel and the second vital processing channel. The method further includes determining in each of the first vital processing unit and the second vital processing unit the state of the item of railroad wayside signaling equipment based on one or more of the first current measurement, the second current measurement and the measured voltage levels, wherein the first vital processing unit and the second vital processing unit are able to detect failures within the item of railroad wayside signaling equipment and failures within the monitoring apparatus itself based on one or more of the first current measurement, the second current measurement and the measured voltage levels, and wherein the state of the item of railroad wayside signaling equipment will comprise an error state if a failure within the item of railroad wayside signaling equipment or a failure within the monitoring apparatus itself is detected.

Therefore, it should now be apparent that the invention substantially achieves all the above aspects and advantages. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

BRIEF DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

FIG. 3 is an exemplary truth table on which cross-check logic implemented in each of the vital processing units of the wayside signaling system of FIG. 1 may be based.

DETAILED DESCRIPTION OF THE EXEMPLARY EMBODIMENTS

Figure 1:
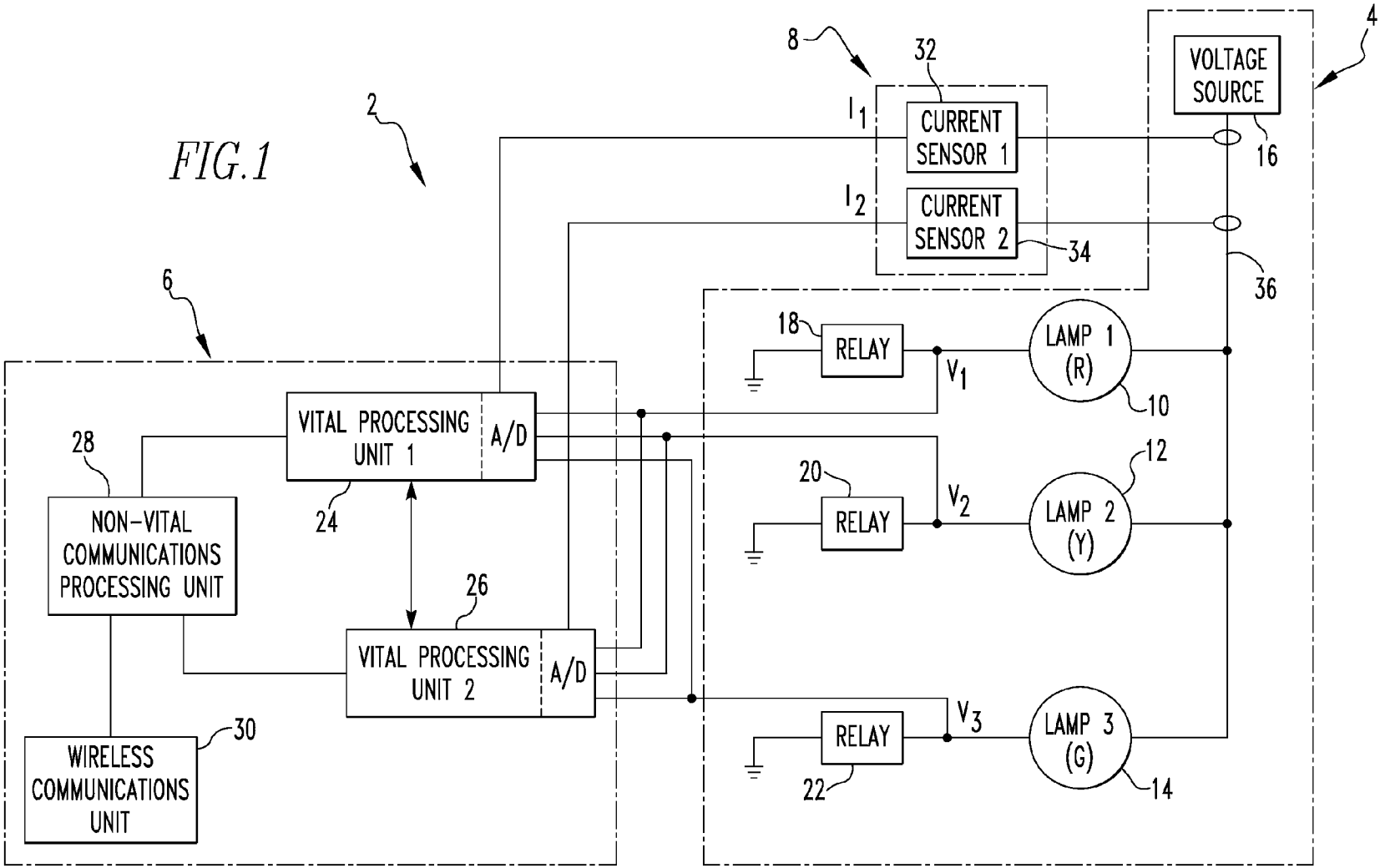
FIG. 1 is a block diagram of a wayside signaling system according to an exemplary embodiment of the present invention.

Directional phrases used herein, such as, for example and without limitation, top, bottom, left, right, upper, lower, front, back, and derivatives thereof, relate to the orientation of the elements shown in the drawings and are not limiting upon the claims unless expressly recited therein.

As employed herein, the statement that two or more parts or components are "coupled" together shall mean that the parts are joined or operate together either directly or through one or more intermediate parts or components.

As employed herein, the statement that two or more parts or components "engage" one another shall mean that the parts exert a force against one another either directly or through one or more intermediate parts or components.

As employed herein, the term "number" shall mean one or an integer greater than one (i.e., a plurality).

FIG. 1 is a block diagram of a wayside signaling system 2 according to an exemplary embodiment of the present invention. Wayside signaling system 2 includes a signal lamp head 4, a wayside interface unit (WIU) 6 and a current sensing unit 8, each of which is described in greater detail herein.

Signal lamp head 4 in the exemplary embodiment is configured to provide visual signals to an oncoming train relating to, for example, right-of-way and/or speed restriction information and includes a first lamp element 10, a second lamp element 12 and a third lamp element 14. As seen in FIG. 1, first lamp element 10 is a red lamp, second lamp element 12 is a yellow lamp and third lamp element 14 is a green lamp, although it will be appreciated that other configuration are also possible within the scope of the present invention. In addition, each lamp element 10, 12, 14 may be an LED lamp element, an incandescent lamp element, or some other type of suitable lamp element. Signal lamp head 4 further includes a voltage source 16, such as a battery, for providing a suitable voltage (e.g., +12V DC) to each lamp element 10, 12, 14 in order to cause the lamp element 10, 12, 14 to be in an on condition. Each lamp element 10, 12, 14 is also connected to ground through an associated, individually controllable relay 18, 20, 22 such that each lamp element 10, 12, 14 will only be caused to be in the on condition when a voltage is being supplied by voltage source 16 and the associated relay 18, 20, 22 is caused to be in a closed condition. Thus, each lamp element 10, 12, 14 is individually controllable between on and off conditions by controlling the associated relay 18, 20, 22.

WIU 6 is configured to monitor the state of signal lamp head 4, declare an aspect for signal lamp head 4 based on sensed voltages and currents in the signal lamp head 4 (described in greater detail herein), and wirelessly transmit the declared aspect so that it can be received by an oncoming train (i.e., by the on-board computer of the oncoming train). WIU 6 includes a first vital processing unit 24 and a second vital processing unit 26 that is separate and diverse from the first vital processing unit 24. First vital processing unit 24 and second vital processing unit 26 each comprise a suitable processing device such as, without limitation, a field programmable gate array (FPGA), a microprocessor, or a microcontroller. As used herein, the term diverse shall mean that the vital processing units 24, 26 are of a different kind, form, or character such that their failure modes will be different. For example, they may be different models or brands of FPGAs or microcontrollers. As seen in FIG. 1, first vital processing unit 24 and second vital processing unit 26 each include analog to digital (A/D) converter portions for receiving analog signals as described elsewhere herein (e.g., analog voltages and currents) and converting those analog signals to suitable digital signals.

WIU 6 is structured to enable first vital processing unit 24 and second vital processing unit 26 to communicate with one another. In addition, first vital processing unit 24 and second vital processing unit 26 are each operatively coupled to a non-vital communications processing unit 28, such as an FPGA, a microprocessor, or a microcontroller, which in turn is operatively coupled to a wireless communications unit 30, such as an RF radio element. As described in greater detail herein, first vital processing unit 24 and second vital processing unit 26 implement a two-out-of two (2oo2) voting architecture which receives voltage and current readings taken from signal lamp head 4 and declares an aspect for the signal lamp head 4 based thereon. That aspect is then communicated to non-vital communications processing unit 28, which then causes the aspect to be wirelessly transmitted via wireless communications unit 30.

As seen in FIG. 1, first vital processing unit 24 and second vital processing unit 26 each receive a separate voltage input from each of the lamp elements 10, 12, 14 ($V_1$, $V_2$, $V_3$). In the illustrated embodiment, first vital processing unit 24 and second vital processing unit 26 are each coupled to and thus each receive a voltage input ($V_1$, $V_2$, $V_3$) from a node located in between each lamp element 10, 12, 14 and the associated relay 18, 20, 22. Thus, if a relay 18, 20, 22 is closed, the received voltage input will be equal to the voltage being supplied to the associated lamp element 10, 12, 14, and if a relay 18, 20, 22 is open, the received voltage input will be equal to zero. As a result, first vital processing unit 24 and second vital processing unit 26 are each able to determine whether a lamp element 10, 12, 14 is being commanded to be on (relay closed) or off (relay open) based on the received voltage (e.g., if the voltage is in excess of some threshold value). In an alternative embodiment, a voltage monitor may be connected across each lamp element 10, 12, 14 in order to measure the voltage being supplied to the associated lamp element 10, 12, 14.

In addition, as noted above, wayside signaling system 2 includes current sensing unit 8. As seen in FIG. 1, current sensing unit 8 is structured to measure the current being provided to the lamp elements 10, 12, 14 and thus is coupled to the common source line 36 between voltage source 16 and lamp elements 10, 12, 14 (in an alternative embodiment, current sensing unit 8 may be coupled to the common return line for the lamp elements 10, 12, 14). Current sensing unit 8 includes a first current sensor 32 and a second current sensor 34, each of which is structured to independently measure the current in the source line ($I_1$ and $I_2$). As seen in FIG. 1, the current measured by first current sensor 32 is provided to first vital processing unit 24 and the current measured by second current sensor 34 is provided to second vital processing unit 26. Alternatively, each measured current could be provided to both first vital processing unit 24 and second vital processing unit 26 (this will allow the current comparison that is described below to be made without the need for the vital processing units 24, 26 to exchange current information as also described below).

Figure 2:
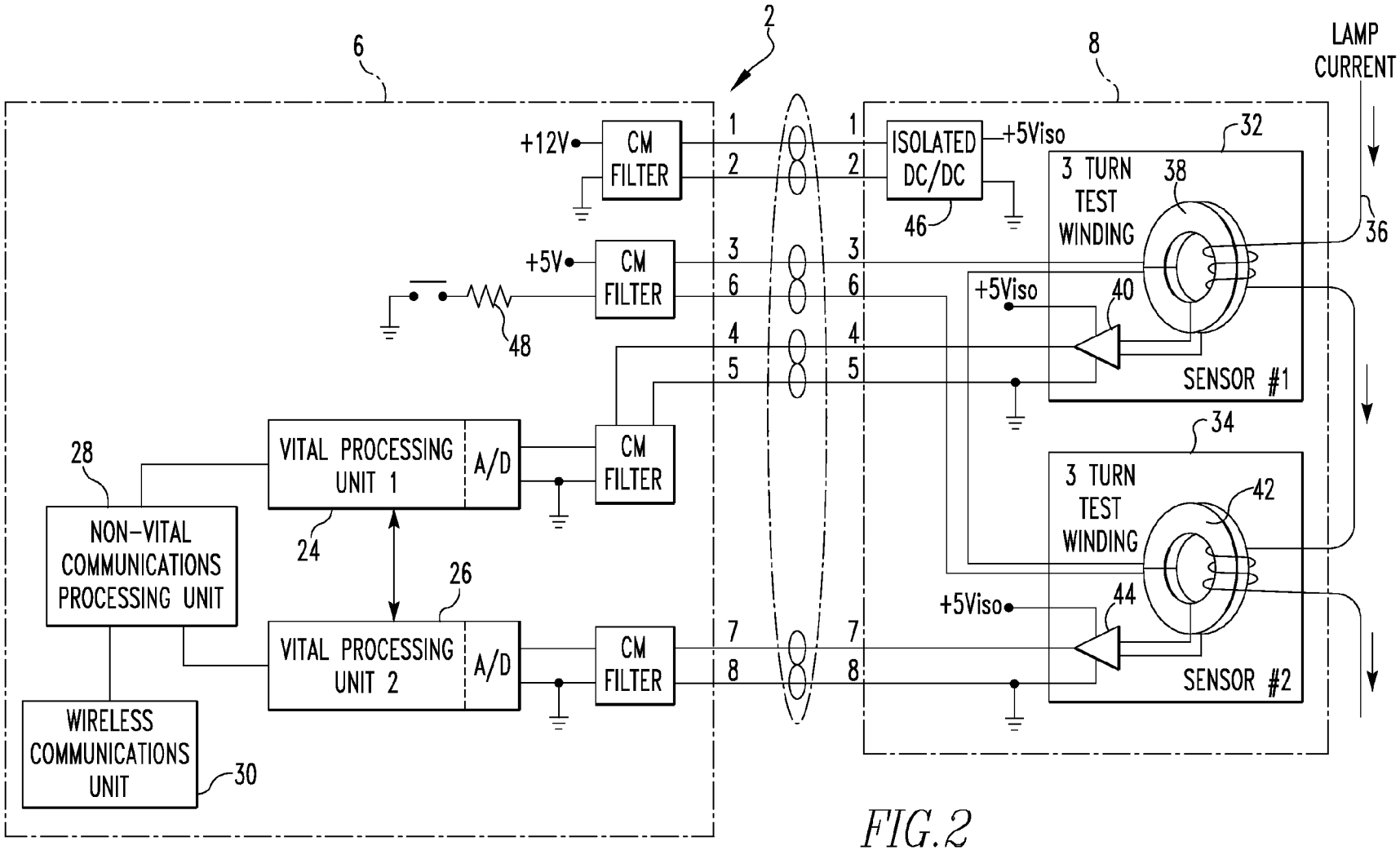
FIG. 2 is a schematic diagram of a portion of the wayside signaling system of FIG. 1 including one particular exemplary embodiment of a current sensing unit forming a part thereof.

FIG. 2 is a schematic diagram of a portion of wayside signaling system 2 including one particular, non-limiting exemplary embodiment of current sensing unit 8. For simplicity, FIG. 2 only shows a portion of signal lamp head 4 (i.e., source line 36). In current sensing unit 8 of the illustrated embodiment, a first current sensor 32 includes a hall effect sensing element 38 coupled to an op-amp 40, and second current sensor 34 includes a hall effect sensing element 42 coupled to an op-amp 44. As seen in FIG. 2, first current sensor 32 and second current sensor 34 sit in series with source line 36 in a manner wherein source line 36 feeds the current in opposite directions (opposite polarities) to hall effect sensing elements 38, 42. This makes the readings from first current sensor 32 and second current sensor 34 distinguishable from one another, where the outputs from first current sensor 32 and second current sensor 34 are 180 degrees out of phase with each other. The output of op-amp 40 is fed into first vital processing unit 24 and the output of op-amp 44 is fed into second vital processing unit 26. In addition, as seen in FIG. 2, first current sensor 32 and second current sensor 34 share a common power source 46 (fed from WIU 6), and are also fed from a test current source 48 (from WIU 6), which is used to determine whether first current sensor 32 and second current sensor 34 are functioning properly and to known, calibrated levels.

According to an aspect of one exemplary embodiment of the invention, the voltages received by first vital processing unit 24 are provided to second vital processing unit 26 and the voltages received by second vital processing unit 26 are provided to first vital processing unit 24. Each of the vital processing units 24, 26 then compares the voltages it received directly from its input channel to the voltages it received from the other one of the vital processing units 24, 26. In an alternative embodiment, the vital processing units 24, 26 will exchange their determinations as to which lamp elements 10, 12, 14 are being commanded to be on, and then compare those determinations. If the results of the comparisons in each of the vital processing units 24, 26 agree, then the voltage data received by both first vital processing unit 24 and second vital processing unit 26 will be deemed valid and suitable for future use as described herein. However, if the comparisons disagree, then an error state will be declared and reported to non-vital communications processing unit 28.

In addition, the first vital processing unit 24 and the second vital processing unit 26 will also exchange the current data each received from the respective first current sensor 32 and second current sensor 34. Each of the vital processing units 24, 26 will then compare the current reading it received directly from its input channel to the inverse of the current reading it received from the other one of the vital processing units 24, 26. If this comparison determines that the current readings agree, then the current data received by both first vital processing unit 24 and second vital processing unit 26 will be deemed valid and suitable for future use as described herein. However, if the current readings disagree, then an error state will be declared and reported to non-vital communications processing unit 28. As will be appreciated, this implementation protects against problems/failures that may occur in the input channels of either first vital processing unit 24 or second vital processing unit 26 and/or in current sensing unit 8.

Furthermore, first vital processing unit 24 and second vital processing unit 26 is each programmed to independently determine an aspect for signal lamp head 4 based on voltage and current data. In the exemplary embodiment, first vital processing unit 24 and second vital processing unit 26 will only act upon and process voltage and current data that is determined to be valid as just described. More specifically, first vital processing unit 24 and second vital processing unit 26 are each programmed with software which applies a series of logic cross checks to voltage and current data to determine the aspect of signal lamp head 4. In an exemplary embodiment, the cross-check logic implemented in each of the vital processing units 24, 26 is based on the truth table shown in FIG. 3, although it will be understood that other, alternative truth tables and cross check logic implementations may also be employed within the scope of the present invention.

As seen in FIG. 3, in the first four cases, the software is able to determine a valid declared state for signal lamp head 4, whereas in the remaining cases, the software will determine that some type or problem/failure has occurred and will declare an error state. Additionally, further errors states may be detected by the software for the first three cases of the table shown in FIG. 3. More particularly, if current sensors 32 and 34 are active but are detecting current levels that are out of correspondence with a single one of the lamp elements 10, 12, 14 being lit (e.g., higher current level than expected for the installed bulb wattage), such a case could indicate that more than one lamp element 10, 12, 14 is being driven (commanded on) erroneously, and that the vital processing unit 24 or 26 is failing to detect the second one of the lamp elements 10, 12, 14 being commanded on (for instance, due to a break in the voltage monitoring line into the vital processing unit 24 or 26). In such a case, the software would also declare an unknown or error state due to failing to monitor the expected current levels.

Once each of first vital processing unit 24 and second vital processing unit 26 has independently determined an aspect for signal lamp head 4, each provides its determined aspect to the other and a voting process is performed to determine a final declared aspect for signal lamp head 4, with the final declared aspect in the exemplary embodiment being either Red, Yellow, Green, Dark or Error. In the voting process according to the exemplary embodiment, if the independently determined aspects agree, then that is the final declared aspect. If, however, the independently determined aspects do not agree, then the most restrictive of the two is deemed the final declared aspect. In an alternative embodiment, if the independently determined aspects do not agree, then the final declared aspect may be deemed to be Error.

Furthermore, according to an aspect of the exemplary embodiment of the present invention, the final determined aspect is communicated to non-vital communication processing unit 28 in a manner wherein a part of the message comes from each of first vital processing unit 24 and second vital processing unit 26 (the units act cooperatively). In particular, in the exemplary embodiment, the final determined aspect is communicated to non-vital communication processing unit 28 bit by bit with the first vital processing unit 24 and second vital processing unit 26 providing alternating bits (i.e., odd bits in the message are communicated by one of first vital processing unit 24 and second vital processing unit 26 and even bits in the message are communicated by the other of first vital processing unit 24 and second vital processing unit 26). Thus, the message ultimately constructed by non-vital communication processing unit 28 from the received bits will only be valid if the final declared aspect that is communicated from each of first vital processing unit 24 and second vital processing unit 26 agree. If they do not agree, the message that is constructed by non-vital communication processing unit 28 from the received bits will not be able to be validated by and will not make any sense to, for example, the on-board computer of an oncoming train. For example, such a message will not be able to be validated using a cyclic redundancy check (CRC) that is by design incorporated into the message/data stream. This protects against possible failures in each of first vital processing unit 24 and second vital processing unit 26 that may cause the final declared aspect that is communicated to be differ than that which was determined during the voting process (e.g., where an output channel or buffer of first vital processing unit 24 or second vital processing unit 26 is stuck in a certain condition).

While preferred embodiments of the invention have been described and illustrated above, it should be understood that these are exemplary of the invention and are not to be considered as limiting. Additions, deletions, substitutions, and other modifications can be made without departing from the spirit or scope of the present invention. Accordingly, the invention is not to be considered as limited by the foregoing description but is only limited by the scope of the appended claims.

What is claimed is:

1. A monitoring apparatus for determining a state of an item of railroad wayside signaling equipment having a plurality of signaling elements, the monitoring apparatus comprising:

a first vital processing unit;

a second vital processing unit separate and diverse from the first vital processing unit;

a current sensing unit having a first current sensor and a second current sensor, the first current sensor and the second current sensor each being configured to measure a current being provided to one or more of the plurality of signaling elements; and means for measuring a plurality of voltage levels, each of the voltage levels being a voltage level being supplied to a respective one of the plurality of signaling elements;

wherein the first vital processing unit receives a first current measurement from the first current sensor and each of the measured voltage levels, wherein the second vital processing unit receives a second current measurement from the second current sensor and each of the measured voltage levels, and wherein the first vital processing unit and the second vital processing unit are each programmed to determine based on one or more of the first current measurement, the second current measurement and the measured voltage levels: (i) the state of the item of railroad wayside signaling equipment, (ii) failures within the item of railroad wayside signaling equipment, and (iii) failures within the monitoring apparatus itself.

2. The monitoring apparatus according to claim 1, wherein the first vital processing unit receives the second current measurement, wherein the second vital processing unit receives the first current measurement, wherein the first vital processing unit and the second vital processing unit are each programmed to determine whether the first current measurement and the second current measurement agree and determine that a failure has occurred within the monitoring apparatus itself if it is determined that the first current measurement and the second current measurement do not agree.

3. The monitoring apparatus according to claim 2, wherein the first current sensor comprises a first hall effect sensor, wherein the second current sensor comprises a second hall effect sensor, and wherein the current being provided to one or more of the plurality of signaling elements is fed to the first hall effect sensor and the second hall effect sensor in opposite polarities.

4. The monitoring apparatus according to claim 1, wherein the first vital processing unit receives each of the measured voltage levels on a first input channel and makes a first determination in the first input channel as to which of the plurality of signaling elements is receiving a supply voltage, wherein the second vital processing unit receives each of the measured voltage levels on a second input channel and makes a second determination in the second input channel as to which of the plurality of signaling elements is receiving a supply voltage, wherein the first vital processing unit receives the second determination, wherein the second vital processing unit receives the first determination, and wherein the first vital processing unit and the second vital processing unit are each programmed to determine whether the first determination and the second determination agree and determine that a failure has occurred within the monitoring apparatus itself if it is determined that the first determination and the second determination do not agree.

5. The monitoring apparatus according to claim 1, wherein the first vital processing unit receives each of the measured voltage levels on a first input channel and registers a first plurality of voltages in the first channel, wherein the second vital processing unit receives each of the measured voltage levels on a second input channel and registers a second plurality of voltages in the second channel, wherein the first vital processing unit receives the registered second plurality of voltages, wherein the second vital processing unit receives the registered first plurality of voltages, and wherein the first vital processing unit and the second vital processing unit are each programmed to determine whether the registered first plurality of voltages and the registered second plurality of voltages agree and determine that a failure has occurred within the monitoring apparatus itself if it is determined that the registered first plurality of voltages and the registered second plurality of voltages do not agree.

6. The monitoring apparatus according to claim 1, wherein the first vital processing unit and the second vital processing unit are each programmed to implement cross-check logic which, using inputs based on either the first current measurement or the second current measurement and the measured voltage levels, determines either a valid declared state for the railroad wayside signaling equipment or that an error condition exists.

7. The monitoring apparatus according to claim 1, wherein the first vital processing unit is programmed to, using cross-check logic and inputs based on the first current measurement and the measured voltage levels, make a first state determination comprising either a valid declared state for the railroad wayside signaling equipment or that an error condition exists, and wherein the second vital processing unit is programmed to, using the cross-check logic and inputs based on the second current measurement and the measured voltage levels, make a second state determination comprising either a valid declared state for the railroad wayside signaling equipment or that an error condition exists.

8. The monitoring apparatus according to claim 7, wherein the first vital processing unit and the second vital processing unit are each programmed to determine a final state determination based on the first state determination and the second state determination.

9. The monitoring apparatus according to claim 8, wherein the final state determination comprises the most restrictive of the first state determination and the second state determination.

10. The monitoring apparatus according to claim 9, further comprising a non-vital communications processing unit coupled to a wireless communication unit, wherein the first vital processing unit and the second vital processing unit are each programmed to cooperatively cause a final state determination message to be communicated to the non-vital communications processing unit based on the final state determination determined in each of the first vital processing unit and the second vital processing unit, wherein the non-vital communications processing unit is programmed to cause the wireless communication unit to wirelessly transmit the final state determination message.

11. The monitoring apparatus according to claim 9, wherein the first vital processing unit and the second vital processing unit are each programmed to provide and communicate to the non-vital communications processing unit alternating bits of the final state determination message based on the final state determination determined in each of the first vital processing unit and the second vital processing unit.

12. The monitoring apparatus according to claim 1, further comprising a wireless communication unit, wherein the first vital processing unit and the second vital processing unit are each programmed to cause a message identifying an error state to be wirelessly transmitted by the wireless communication unit if a failure within the item of railroad wayside signaling equipment or within the monitoring apparatus itself is determined.

13. The monitoring apparatus according to claim 1, wherein the item of railroad wayside signaling equipment comprises a signal lamp head.

14. A method of determining a state of an item of railroad wayside signaling equipment having a plurality of signaling elements, comprising:

providing a monitoring apparatus having a first vital processing channel and a second vital processing channel separate and diverse from the first vital processing channel;

making a first current measurement and a second current measurement, both the first current measurement and the second current measurement comprising a measurement of a current being provided to one or more of the plurality of signaling elements;

receiving in the first vital processing channel the first current measurement and receiving in the second vital processing channel the second current measurement;

measuring a plurality of voltage levels, each of the voltage levels being a voltage level being supplied to a respective one of the plurality of signaling elements;

receiving the measured voltage levels in the first vital processing channel and the second vital processing channel;

determining in each of the first vital processing unit and the second vital processing unit the state of the item of railroad wayside signaling equipment based on one or more of the first current measurement, the second current measurement and the measured voltage levels, wherein the first vital processing unit and the second vital processing unit are able to detect failures within the item of railroad wayside signaling equipment and failures within the monitoring apparatus itself based on one or more of the first current measurement, the second current measurement and the measured voltage levels, and wherein the state of the item of railroad wayside signaling equipment will comprise an error state if a failure within the item of railroad wayside signaling equipment or a failure within the monitoring apparatus itself is detected.

15. The method according to claim 14, further comprising receiving the second current measurement in the first vital processing channel and the first current measurement in the second vital processing channel, determining in the first vital processing channel and the second vital processing channel whether the first current measurement and the second current measurement agree and determining in each of the first vital processing channel and the second vital processing channel that a failure has occurred within the monitoring apparatus itself if it is determined that the first current measurement and the second current measurement do not agree.

16. The method according to claim 14, further comprising making a first determination in the first vital processing channel as to which of the plurality of signaling elements is receiving a supply voltage, making a second determination in the second vital processing channel as to which of the plurality of signaling elements is receiving a supply voltage, receiving the second determination in the first vital processing channel and the first determination in the second vital processing channel, and determining in each of the first vital processing channel and the second vital processing channel whether the first determination and the second determination agree and determining in each of the first vital processing channel and the second vital processing channel that a failure has occurred within the monitoring apparatus itself if it is determined that the first determination and the second determination do not agree.

17. The method according to claim 14, wherein the first vital processing channel registers a first plurality of voltages in response to receiving each of the measured voltage levels, wherein the second vital processing channel registers a second plurality of voltages in response to receiving each of the measured voltage levels, the method further comprising determining in each of the first vital processing channel and the second vital processing channel whether the registered first plurality of voltages and the registered second plurality of voltages agree and determining and determining in each of the first vital processing channel and the second vital processing channel that a failure has occurred within the monitoring apparatus itself if it is determined that the registered first plurality of voltages and the registered second plurality of voltages do not agree.

18. The method according to claim 14, further comprising using cross-check logic and inputs based on the first current measurement and the measured voltage levels in the first vital processing channel to make a first state determination comprising either a valid declared state for the railroad wayside signaling equipment or that an error condition exists, and using the cross-check logic and inputs based on the second current measurement and the measured voltage levels in the second vital processing channel to make a second state determination comprising either a valid declared state for the railroad wayside signaling equipment or that an error condition exists.

19. The method according to claim 18, further comprising determining in each of the first vital processing channel and the second vital processing channel a final state determination based on the first state determination and the second state determination.

20. The method according to claim 19, wherein the final state determination comprises the most restrictive of the first state determination and the second state determination.

21. The method according to claim 20, further comprising cooperatively creating a final state determination message using the first vital processing unit and the second vital processing unit based on the final state determination determined in each of the first vital processing unit and the second vital processing unit, and causing the final state determination message to be wirelessly transmitted.

22. The method according to claim 21, wherein the cooperatively creating providing alternating bits of the final state determination message from the first vital processing unit and the second vital processing unit based on the final state determination determined in each of the first vital processing unit and the second vital processing unit.

* * * * *

UNITED STATES PATENT AND TRADEMARK OFFICE

CERTIFICATE OF CORRECTION

PATENT NO. : 8,515,697 B2
APPLICATION NO. : 13/037939
DATED : August 20, 2013
INVENTOR(S) : Michael Alexander et al.

It is certified that error appears in the above-identified patent and that said Letters Patent is hereby corrected as shown below:

On the Title page, item (56), second column, OTHER PUBLICATIONS, line 1, "Communications-Based Signaling (CBS) - Vital PTC," should read --"Communications-Based Signaling (CBS) - Vital PTC,"--.
Title page 2, second column, OTHER PUBLICATIONS, line 1, "Inoperable Positive Train Control (PTC)," should read --"Inoperable Positive Train Control (PTC),"--.

In the Specification
Column 1, line 50, "device" should read --devices--.
Column 3, line 44, "configuration" should read --configurations--.
Column 6, line 13, "cross check" should read --cross-check--.
Column 6, line 18, "or" should read --of--.
Column 6, line 19, "errors" should read --error--.
Column 7, line 9, "differ" should read --different--.

In the Claims
Column 10, line 17, "and determining and determining" should read --and determining--.
Column 11, line 4, "creating providing alternating bits" should read --creating includes providing alternating bits--.

Signed and Sealed this
Eleventh Day of February, 2014

Michelle K. Lee

Michelle K. Lee
*Deputy Director of the United States Patent and Trademark Office*